US005911517A

United States Patent [19]

Norberto

[11] Patent Number: 5,911,517

[45] Date of Patent: Jun. 15, 1999

[54] ANTIWAVE BULKHEAD

[75] Inventor: Frank Norberto, Patchogue, N.Y.

[73] Assignee: Evanti Swimming Pool Equipment Corp., Patchogue, N.Y.

[21] Appl. No.: 09/048,346

[22] Filed: Mar. 26, 1998

[51] Int. Cl.[6] ..... E04H 4/14

[52] U.S. Cl. ..... 4/497; 4/505

[58] Field of Search ..... 4/497, 496, 505, 4/510, 511; 52/169.7, 243.1

[56] References Cited

U.S. PATENT DOCUMENTS

| | | | |
|---|---|---|---|
| 3,011,178 | 12/1961 | Stone | 4/497 |
| 3,577,570 | 5/1971 | Vincent | 4/497 |
| 3,842,484 | 10/1974 | Stark . | |
| 3,849,807 | 11/1974 | Lowe | 4/497 |
| 3,935,599 | 2/1976 | Stark . | |
| 3,962,735 | 6/1976 | Davidson . | |
| 4,292,696 | 10/1981 | Berger . | |
| 4,574,404 | 3/1986 | Stark, Sr. . | |
| 4,593,421 | 6/1986 | Cohen | 4/510 |
| 4,706,309 | 11/1987 | Van Den Broek | 4/510 |
| 4,969,219 | 11/1990 | Stark, Sr. . | |

*Primary Examiner*—Charles R. Eloshway
*Attorney, Agent, or Firm*—Stephen E. Feldman

[57] ABSTRACT

An antiwave bulkhead for use in swimming pools is disclosed which comprises a plurality of separate bulkhead units, each bulkhead unit having a pair of buoyancy tanks secured within them each of which are provided with air supply conduits enabling air to be independently supplied to or independently evacuated from each of the buoyancy tanks. The bulkhead units include an elongated slot in their front walls at pool water level to admit water into the bulkhead units caused by the bow wave of an approaching swimmer and grating at the lower ends of the bulkhead units to displace the excess admitted water.

5 Claims, 2 Drawing Sheets

ANTIWAVE BULKHEAD

FIELD OF THE INVENTION

This invention relates to bulkheads for use in swimming pools. More particularly, this invention relates to a swimming pool bulkhead that is stable, will not torque or twist, can readily compensate for shifts or differences in weight imposed on the bulkhead, and which minimizes or virtually eliminates wave action against a swimmer approaching the bulkhead to make a turn.

BACKGROUND OF THE INVENTION

The use of movable bulkheads in swimming pools to provide a predetermined distance barrier for swimmers in competition, recreational swimmers or those who swim for health and exercise is well known. Attempts have been made to provide artificial barriers; i.e., bulkheads, that are transportable, can be readily moved along the sides of a pool to accommodate for different distances, and which are resistant to twisting or torque action after being secured in place in a swimming pool.

For example, U.S. Pat. No. 3,842,484 to Stark discloses a swimming pool bulkhead equipped with lateral wheels to facilitate moving the bulkhead up and down the length of a pool. U.S. Pat. No. 3,935,599 to Stark also discloses a swimming pool bulkhead having end rollers for moving a bulkhead up and down the length of a swimming pool. U.S. Pat. No. 3,962,735 to Davidson discloses a motorized mechanism for moving a swimming pool bulkhead up and down the length of a swimming pool. U.S. Pat. No. 4,574,404 to Stark discloses a swimming pool bulkhead having buoyancy tanks at the outward ends of the bulkhead compartments to facilitate moving the bulkhead. U.S. Pat. No. 4,969,219 discloses a swimming pool bulkhead having buoyancy tanks at opposite ends of the bulkhead and at selected transverse locations to facilitate raising the bulkhead uniformly.

While these prior art swimming pool bulkheads provide useful improvements in overall bulkhead designs, they do not completely minimize or eliminate torque or twisting of the bulkhead, nor do they compensate for differences in weight distribution along the length of the bulkhead, nor do they facilitate movement of the bulkhead without adding costly and heavy mechanisms, and they do not compensate for a swimmer's "bow wave" as the swimmer approaches the bulkhead which, in competitive events, can mean the difference between winning and losing.

SUMMARY OF THE INVENTION

It has now been found that these shortcomings in prior art bulkheads are overcome by the antiwave swimming pool bulkhead of the invention. In general, the antiwave bulkhead of the invention comprises a plurality of separate bulkhead units, each unit comprising: a top and bottom wall, a front and rear wall and opposed side walls which collectively define an enclosed bulkhead well; a grating at the lower end of said front and rear walls to admit water from the pool into said bulkhead well; an elongated slot formed adjacent the upper end of said front wall; a front and rear buoyancy tank secured within each of said bulkhead wells; air supply conduits having an outlet communicating with the interior of each of said buoyancy tanks; means to supply air into each of said buoyancy tanks through said air supply conduits; and, means to evacuate air from said buoyancy tanks through said air supply conduits.

In one embodiment of the antiwave bulkhead of the invention apertures are formed in the bottom of the buoyancy tanks to permit pool water to enter the tanks to compensate for weight differences on the bulkhead.

In another embodiment of the antiwave bulkhead of the invention, a finger grip in the form of an elongated ridge is provided at the upper edge of each of said bulkhead units.

In a further embodiment of the antiwave bulkhead of the invention openings are formed in the top walls of the bulkhead units communicating with the interior of the bulkhead wells to drain water from the swimmers on the bulkhead.

BRIEF DESCRIPTION OF THE DRAWING

The anti-wave bulkhead of the invention will become more apparent from the ensuing description when considered together with the accompanying drawing wherein.

DETAILED DESCRIPTION OF THE DRAWING AND THE INVENTION

Figure 1:
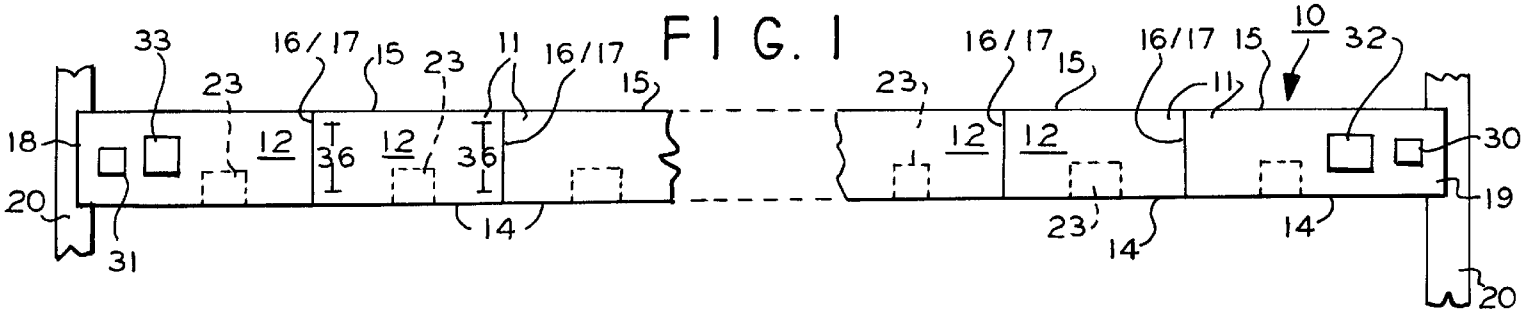
FIG. 1 is a partly fragmented plan view of the antiwave bulkhead of the invention.
Figure 2:
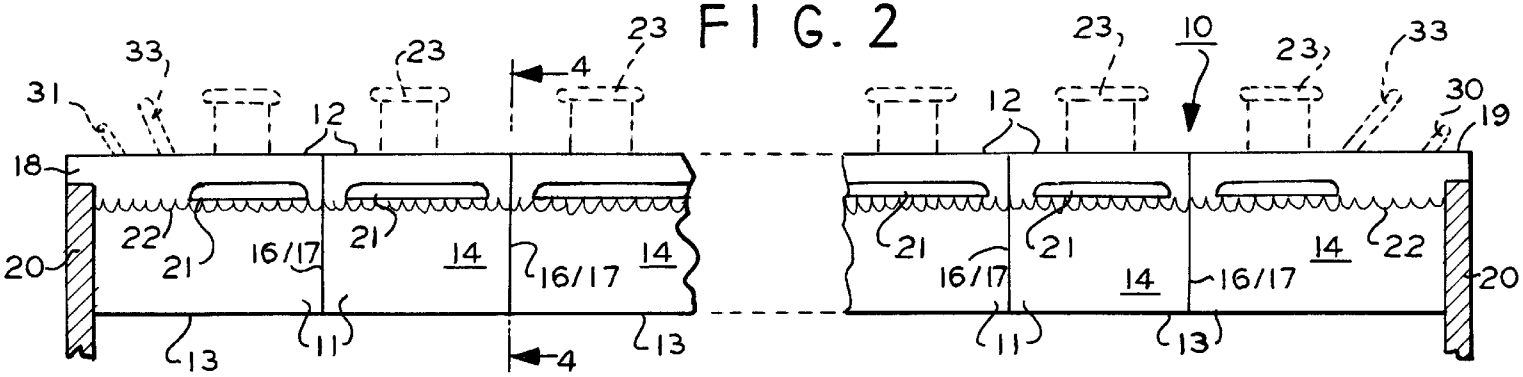
FIG. 2 is a partly fragmented elevation view of the antiwave bulkhead of the invention.
Figure 3:
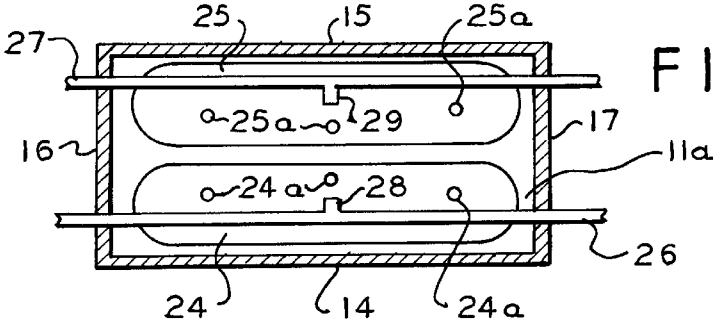
FIG. 3 is a sectional view of an individual unit with the top wall removed for clarity; and, FIG. 4 is an enlarged, stepped sectional view taken substantially on the line 4—4 of FIG. 2.

Turning now to the drawing wherein like reference numerals denote like parts, it can be seen from the illustration of FIGS. 1 and 2 that the antiwave bulkhead of the invention, generally identified by reference numeral 10, comprises a plurality of bulkhead units 11 each of which has a top wall 12, a bottom wall 13, a front wall 14, a rear wall 15 and opposed side walls 16 and 17 which collectively form a generally rectangular bulkhead well enclosure 11*a* (FIG. 3). The opposed ends 18 and 19 of the bulkhead 10 are positioned on and supported by swimming pool walls 20.

An elongated slot 21 (FIG. 2) is formed adjacent the upper end of the front wall 14 in each of the bulkhead units 11 which are balanced so that the slots 21 are even with or just above the water level 22 of the pool. As can be seen in FIGS. 1 and 2, each of the bulkhead units 11 typically has mounted thereon starting blocks 23 for competing swimmers.

Figure 4:
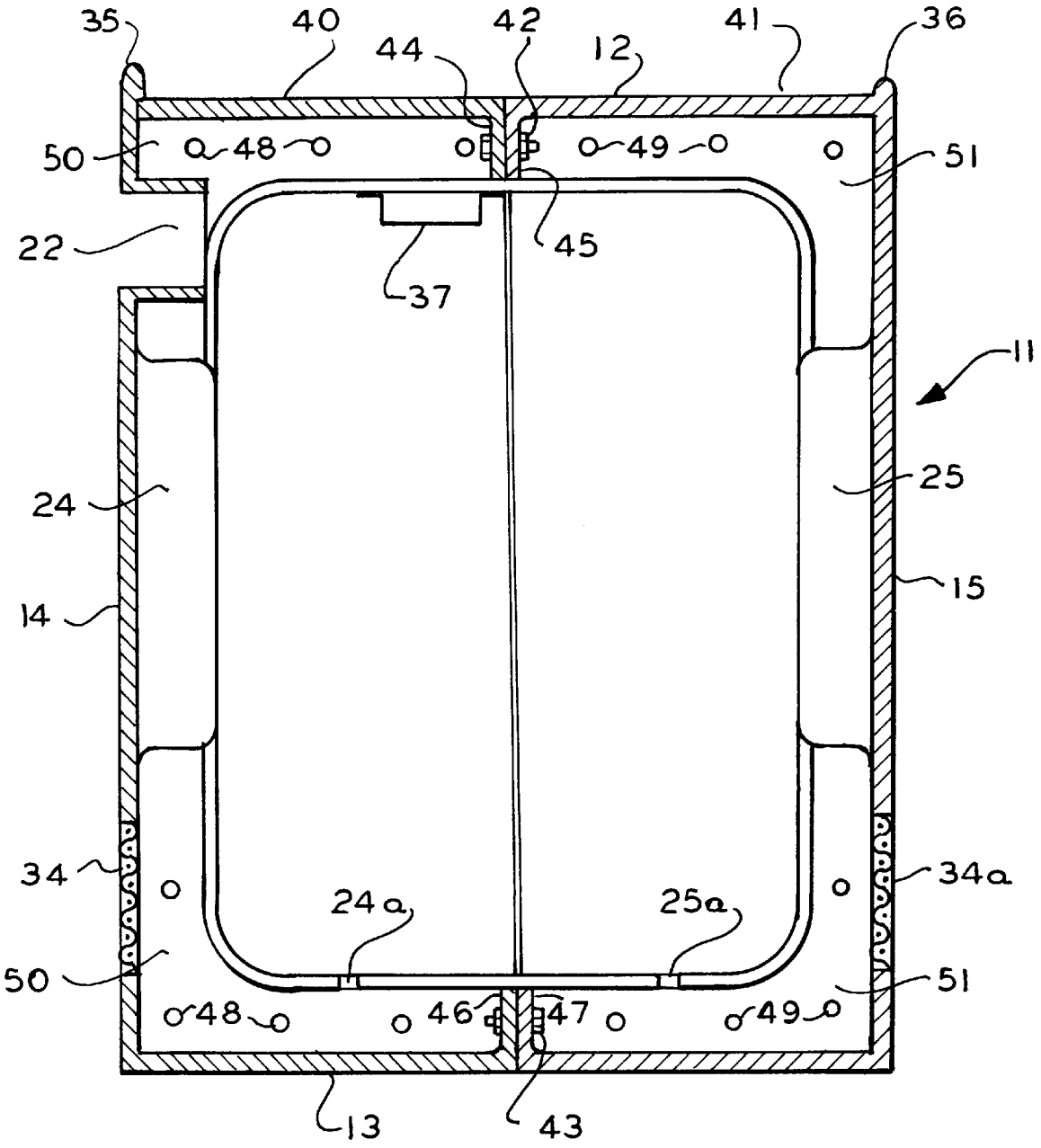

As shown in FIG. 3, a front and rear pair of buoyancy tanks 24 and 25, respectively, are secured within each of the bulkhead units 11 and have a plurality of apertures 24*a* and 25*a* formed in their bottoms that communicate with the interior of the bulkhead wells (FIG. 4). Separate air conduits 26 and 27 are strung successively through the front and rear buoyancy tanks 24 and 25. The air conduits 26 and 27 are provided with air ports 28 and 29 that communicate with the interiors of each buoyancy tank 24 and 25. Thus, air under pressure can be supplied from a conventional supply source to each buoyancy tank 24 and 25 from conduits 26 and 27 through air ports 28 and 29. Similarly, and again using conventional means, air can be evacuated from buoyancy tanks through air ports 28 and 29 and air conduits 26 and 27 whereupon pool water will enter the buoyancy tanks 24 and 25 from the bulkhead wells 11*a* through apertures 24*a* and 25*a* in the bottoms of buoyancy tanks 24 and 25.

Air under pressure can be supplied to or evacuated from the buoyancy tanks 24 and 25 by conventional means through air access ports 30 and 31 provided at each end 18 and 19 of the bulkhead 10 (FIGS. 1 and 2). As also shown in FIGS. 1 and 2, man hole access ports 32 and 33 are also provided at each end 18 and 19 of the bulkhead 10. These permit ready access into the interior of the bulkhead 10 for cleaning, maintenance, repairs, alterations, and the like.

As can be seen in FIG. 4, the front and rear walls 14 and 15 of each bulkhead unit 11 has a flow through grating 34 and 34*a*, respectively, adjacent its lower end to permit pool water to enter into the bulkhead well 11*a*. As also shown in FIG. 4, an elongated, elevated ridge 35 and 36 can be provided at the upper end of each of the front and rear walls 14 and 15 to serve as a finger grip for swimmers who must start their competition in the water. A tray to carry timing wires can also be carried within the buoyancy tanks as indicated at 37 in FIG. 4.

In order to keep the top wall 12 of each bulkhead unit as free of water as possible and to prevent accidental slipping by persons walking on the bulkhead, a plurality of slits or openings 38 (FIG. 1) communicating with the interior of the bulkhead wells 11*a* can be provided to drain off water accumulating on the top wall 12 of the bulkhead units 11.

The bulkhead units can be manufactured with balsa cores laminated between suitable plastic outer coatings or covers such as fiberglass, polyvinyls, polyvinylesters, and the like, and the top walls 12 can be fabricated from a conventional, non-skid plastic surface to minimize slipping and falling under wet conditions. Each of the ant-wave bulkhead units 11 of the invention can be manufactured to be about 3' to about 6' in height, from about 6' to about 8' in length, and from about 4' to about 6' in width. The individual bulkhead units 11 can be bolted together, epoxy glued, and laminate coated to provide any desired length of bulkhead 10 to accommodate different pool widths.

The bulkhead units 11 are provided in sections so that they can be easily transported and readily assembled on site. As shown in FIG. 4, the bulkhead units 11 are provided in two sections; a front section 40 and a rear section 41. These sections 40 and 41 are joined together by means of nuts and bolts 42 and 43 through mating flanges 44, 45 and 46, 47. After the front and rear sections 40 and 41 have been assembled to form a bulkhead unit 11, the bulkhead units can then be similarly joined together using nuts and bolts inserted through bolt holes 48 and 49 provided in end flanges 50 and 51 to complete the assembly of the antiwave bulkhead 10.

Once assembled, the bulkhead 10 is lowered into the pool water which enters the bulkhead well 11*a* (FIG. 3) through the flow through gratings 34 and 34*a* at the lower end of the front and rear walls 14 and 15 (FIG. 4). Air is admitted into or evacuated from the buoyancy tanks 24 and 25 via air conduits 26 and 27 and air port 28 and 29 (FIG. 3) until the bulkhead 10 is level and the elongated slot 21 in the front wall 14 is at or just above the level of the pool water 22 (FIG. 2). At this time, the ends 18 and 19 of the bulkhead 10 are secured to the pool walls 20 (FIGS. 1 and 2).

To accommodate different numbers of swimming competitors, starting blocks 23 are often added or removed from the bulkhead 10 (FIGS. 1 and 2). When this occurs, the bulkhead 10 can have a tendency to twist or torque about its longitudinal axis due to increased weight or the loss of weight from the starting blocks 23 and cause the bulkhead to become unbalanced or uneven. However, since air can be independently supplied to or evacuated from the buoyancy tanks 24 and 25 via air conduits 26 and 27 and air ports 28 and 29 (FIG. 3), the bulkhead units 11 affected can be readily adjusted by either adding more air into the buoyancy tanks 24 and 25 or evacuating air from them and permitting water to enter the bulkhead well 11*a* through gratings 34 and 34*a* (FIG. 4) and thence into buoyancy tanks 24 and 25 through apertures 24*a* and 25*a* thereby controlling and overcoming the imbalance or unevenness.

In swimming competition, any water turbulence that slows a swimmer down or tends to interfere with a swimmer's timing is critical and detrimental. One cause of such turbulence is created by the water being displaced in front of a swimmer as a swimmer progresses through the water; i.e., a "bow wave" similar to that created by a boat going through the water. As a swimmer approaches a bulkhead, the swimmer's "bow wave" is pushed into the bulkhead and bounces off the bulkhead back into the swimmer as well as into swimmers in adjacent swimming lanes. By providing the elongated slot 21 adjacent the upper edge of the front wall 14 of each bulkhead unit 11 (FIGS. 2 and 4), this type of "bow wave" turbulence and interference is virtually eliminated. The "bow wave" created by the swimmer is pushed into the elongated slot 21, into the bulkhead well 11*a* and is expelled out of the bulkhead well 11*a* through the gratings 34 and 34*a* in the bottom of the front and rear walls 14 and 15 to completely absorb and dissipate the energy produced by the "bow wave".

Although the antiwave bulkhead of the invention has been described with particularity and in some detail, it will be appreciated by those skilled in this art that changes and modifications can be made therein without departing from the scope and spirit of the invention.

What is claimed:

1. An antiwave swimming pool bulkhead comprising:

(a) a plurality of separate bulkhead units each having a top wall and a bottom wall, a front wall and a rear wall, and opposed side walls, said walls being joined together to collectively define an enclosed bulkhead well;

(b) a grating positioned at the lower end of each of said front and rear walls for admitting pool water into said bulkhead well and permitting water caused by the bow wave of a swimmer to be expelled from said bulkhead well;

(c) an elongated slot formed adjacent the upper end of each said front wall intermediate said side walls, said slot opening into a respective bulkhead well such that said bow wave enters said slot and exits through said grating;

(d) a front and rear buoyancy tank secured within each of said bulkhead wells, each of said buoyancy tanks having a plurality of apertures formed in the bottom walls thereof and communicating with the interior of said bulkhead wells; and, (e) an air supply conduit having an air port communicating with each of said front buoyancy tanks and an air supply conduit communicating with each of said rear buoyancy tanks such that air can be independently supplied to and independently evacuated from said front and rear buoyancy tanks.

2. The antiwave bulkhead of claim 1 wherein a finger grip in the form of an elongated ridge is provided at the upper edge of the front and rear walls in each of said bulkhead units.

3. The antiwave bulkhead of claim 1 wherein the top wall of each of said bulkhead units has a plurality slits formed therein communicating with the interior of said bulkhead well.

4. The antiwave bulkhead of claim 1 which includes a man hole access port at each end of said bulkhead.

5. The antiwave bulkhead of claim 1 which includes means to secure each end of said bulkhead to the sides of a swimming pool wall.

* * * * *